US011261556B2

(12) United States Patent
Hao et al.

(10) Patent No.: US 11,261,556 B2
(45) Date of Patent: Mar. 1, 2022

(54) WASHING MACHINE

(71) Applicant: QINGDAO HAIER WASHING MACHINE CO., LTD., Shandong (CN)

(72) Inventors: Xinghui Hao, Shandong (CN); Sheng Xu, Shandong (CN); Yanfen Lv, Shandong (CN); Di Wu, Shandong (CN); Peishi Lv, Shandong (CN)

(73) Assignee: QINGDAO HAIER WASHING MACHINE CO., LTD., Shandong (CN)

( * ) Notice: Subject to any disclaimer, the term of this patent is extended or adjusted under 35 U.S.C. 154(b) by 0 days.

(21) Appl. No.: 16/636,198

(22) PCT Filed: Aug. 3, 2018

(86) PCT No.: PCT/CN2018/098411
§ 371 (c)(1),
(2) Date: Feb. 3, 2020

(87) PCT Pub. No.: WO2019/024904
PCT Pub. Date: Feb. 7, 2019

(65) Prior Publication Data

US 2020/0370224 A1 Nov. 26, 2020

(30) Foreign Application Priority Data

Aug. 4, 2017 (CN) ..... 201710661293.1

(51) Int. Cl.
*D06F 37/24* (2006.01)
*D06F 23/04* (2006.01)
*D06F 37/26* (2006.01)

(52) U.S. Cl.
CPC ..... *D06F 37/24* (2013.01); *D06F 23/04* (2013.01); *D06F 37/268* (2013.01)

(58) Field of Classification Search
CPC ..... D06F 37/24; D06F 37/268; D06F 23/04
See application file for complete search history.

(56) References Cited

U.S. PATENT DOCUMENTS 3,089,326 A * 5/1963 Belaieff ..... D06F 37/225 68/23.2
3,356,222 A * 12/1967 Belaieff ..... D06F 37/225 210/363

(Continued)

FOREIGN PATENT DOCUMENTS

CN 101424032 B 9/2010
CN 104452184 A 3/2015

(Continued)

OTHER PUBLICATIONS

International Search Report (PCT/ISA/210), with translation, and Written Opinion (PCT/ISA/237) dated Oct. 26, 2018, by the Chinese Patent Office as the International Searching Authority for International Application No. PCT/CN2018/098411.

(Continued)

*Primary Examiner* — Joseph L. Perrin
(74) *Attorney, Agent, or Firm* — Buchanan Ingersoll & Rooney PC

(57) ABSTRACT

A washing machine includes an inner barrel and an outer barrel which are arranged in a washing machine shell. A suspension damping piece and a support damping piece are both connected between the washing machine shell and the outer barrel. The suspension damping piece suspends the outer barrel in the washing machine shell and the support damping piece supports the outer barrel. The support damping piece and the suspension damping piece work together to reduce the shaking of the inner barrel and the outer barrel. The washing machine includes various kinds of damping pieces which are installed to realize mutual coordination and cooperative shock absorption, so that the vibration of the (Continued)

washing machine in all directions can be reduced. Also, the probability that the barrel assembly hits the washing machine shell in the washing process can be greatly reduced.

20 Claims, 4 Drawing Sheets

(56) References Cited

U.S. PATENT DOCUMENTS

| | | | | |
|---|---|---|---|---|
| 5,528,913 | A * | 6/1996 | Savkar | D06F 37/20 68/23.3 |
| 5,613,380 | A * | 3/1997 | Savkar | D06F 37/24 68/23.3 |
| 5,907,880 | A * | 6/1999 | Durazzani | F16F 9/535 8/159 |
| 2015/0184325 | A1* | 7/2015 | Kim | D06F 35/005 8/137 |
| 2017/0030000 | A1 | 2/2017 | Alexander et al. | |
| 2017/0145618 | A1* | 5/2017 | Borlin | D06F 37/263 |
| 2018/0066390 | A1* | 3/2018 | Yu | D06F 39/14 |
| 2018/0073181 | A1* | 3/2018 | Yu | D06F 37/24 |
| 2018/0112345 | A1* | 4/2018 | Yu | F16F 7/08 |
| 2018/0209085 | A1* | 7/2018 | Xu | D06F 37/20 |

FOREIGN PATENT DOCUMENTS

| | | | |
|---|---|---|---|
| CN | 104746283 | A | 7/2015 |
| CN | 105986407 | A | 10/2016 |
| CN | 106868774 | A | 6/2017 |
| CN | 106930045 | A | 7/2017 |
| CN | 108221277 | A | 6/2018 |
| JP | S63-296798 | A | 12/1988 |
| JP | H07-178287 | A | 7/1995 |
| JP | H09-327589 | A | 12/1997 |
| KR | 20040071380 | A | 8/2004 |
| KR | 20160111199 | A | 9/2016 |
| WO | 97/45582 | A1 | 12/1997 |

OTHER PUBLICATIONS

Office Action (Notice of Reasons for Refusal) dated Sep. 14, 2021, in corresponding Japanese Patent Application No. 2020-504674 and English translation of the Office Action. (12 pages).

Office Action dated Jul. 27, 2020, in corresponding Chinese Patent Application No. 201710661293.1 and English translation of the Office Action. (17 pages).

* cited by examiner

WASHING MACHINE

TECHNICAL FIELD

The disclosure relates to the technical field of washing machines, and particularly herein relates to a washing machine.

BACKGROUND

A washing machine is a kind of device that can wash clothes by using electricity. Generally, a washing machine includes a barrel to hold washing water, a rotating barrel which is rotatably installed inside the barrel, an impeller which is rotatably installed at the bottom of the rotating barrel, a motor and a clutch which are used to rotate the rotating barrel and the impeller. When the rotating barrel and the impeller rotate after the clothes and detergent are put into the rotating barrel, the impeller stirs the washing water together with the clothes in the rotating barrel to remove the stains from the clothes.

During the process of clothes washing, when the clothes deviate, the barrel assembly may impact the washing machine shell, resulting in large noise and even the displacement of the washing machine. In order to reduce the bad consequences caused by the impact, some components used for shock absorption are set in the washing machine, such as the suspension rod between the outer barrel and the washing machine shell to reduce the vibration of the washing machine. However, the damping effect is not as good as expected. When the washing machine reaches the resonance point, the impact still often occurs.

In view of this, the disclosure is proposed.

SUMMARY

The technical problem to be solved by the disclosure is to overcome the disadvantages of the prior art and provide a washing machine. The washing machine includes various kinds of damping pieces which are coordinated installed to realize mutual coordination and cooperative shock absorption, so that the vibration of the washing machine in all directions can be reduced. Also, the probability that the barrel assembly hits the washing machine shell in the washing process can be greatly reduced. It can also enhance the anti-deviation capability of the barrel assembly, particularly reduce the vibration effect at a low-speed corresponding to the resonance point. And the noise of the washing machine can also be reduced, as well as the safety of the washing process can be enhanced, so that the user experience can be improved.

In order to solve the technical problem above, the basic idea of the technical scheme adopted by the disclosure is:

The disclosure discloses a washing machine comprising a washing machine shell; an inner barrel and an outer barrel which are arranged in the washing machine shell; a suspension damping piece and a support damping piece which are both arranged between the washing machine shell and the outer barrel, and are connected with the washing machine shell and the outer barrel respectively; the suspension damping piece suspends the outer barrel in the washing machine shell and the support damping piece supports the outer barrel; the support damping piece and the suspension damping piece work together to reduce the shaking of the inner barrel and the outer barrel.

Further, one end of the suspension damping piece is connected with the upper part of the washing machine shell, and the other end is connected with the side wall of the outer barrel; one end of the support damping piece is hinged with the lower part of the washing machine shell, and the other end is hinged with the bottom or the side wall of the outer barrel; the suspension damping piece and the support damping piece are in staggered arrangement.

Further, the washing machine comprises several suspension damping pieces which are evenly distributed along the circumference of the outer barrel; several support damping pieces provided which are evenly distributed around the central axis of the outer barrel; the horizontal projection of the suspension damping pieces and the horizontal projection of the support damping pieces are alternatively distributed;

preferably, the angles between the horizontal projection of the suspension damping piece and that of the two nearest support damping pieces are equal to each other.

Further, both the suspension damping pieces and the support damping pieces are arranged in pairs, each pair of suspension damping pieces and support damping pieces are symmetrical to the central axis of the outer barrel;

preferably, two pairs of suspension damping pieces and two pairs of support damping pieces are included in the washing machine; the plane formed by the two pairs of suspension damping pieces are perpendicular to each other, and the plane formed by the two pairs of support damping pieces are perpendicular to each other.

Further, the suspension damping piece and the support damping piece are arranged between the washing machine shell and the outer barrel with tilting position;

preferably, the suspension damping piece tilts outwards from bottom to top; the support damping piece tilts inwards from bottom to top.

Further, the outer barrel includes an outer barrel bottom and an outer barrel body, and the outer barrel body is connected with the upper part of the outer barrel bottom; one end of the suspension damping piece is connected with the side wall of the outer barrel body, the other end is connected with the washing machine shell; one end of the support damping piece is connected with the bottom or the side wall of the outer barrel bottom, and the other end is connected with the washing machine shell.

Further, a mounting plate, arranged under the outer barrel bottom, is fixedly connected with the outer barrel bottom; one end of the support damping piece is connected with the mounting plate, the other end is connected with the washing machine shell;

preferably, the mounting plate is connected with the bottom of the outer barrel by a stiffener.

Further, the opening of the outer barrel is lower than the opening of the inner barrel.

Further, the wash machine comprises a horizontal damping piece, which is arranged between the outer barrel and the washing machine shell in horizontal direction and is connected with the outer barrel and the washing machine shell respectively, to reduce the horizontal vibration of the outer barrel and the inner barrel;

preferably, the horizontal damping piece is hinged with the outer barrel and the washing machine shell respectively and is arranged between the suspension damping piece and the support damping piece in the vertical direction.

Further, the outer barrel bottom includes a bottom wall and a side wall which are enclosed to form the outer barrel bottom; the horizontal damping piece is connected with the side wall of the outer barrel bottom and the support damping piece is connected with the bottom wall or side wall of the outer barrel bottom;

preferably, the diameter of the side wall of the outer barrel bottom increases gradually from bottom to top, and the horizontal damping piece is connected with the side wall of the outer barrel bottom at a part which has a small diameter.

After adopting the above technical scheme, the disclosure has the following beneficial effects compared with the prior art:

1. The washing machine includes various kinds of damping pieces which are cooperated installed to work together and cooperative shock absorption, so that the vibration of the washing machine in all directions can be reduced. Also, the probability that the barrel assembly hits the washing machine shell in the washing process can be greatly reduced. It can also enhance the anti-deviation capability of the barrel assembly, particularly reduce the vibration effect at a low-speed corresponding to the resonance point. And the noise of the washing machine can also be reduced, as well as the safety of the washing process can be enhanced, so that the user experience can be improved.

2. The damping pieces includes the suspension damping piece and the support damping piece. The suspension damping piece suspends the outer barrel in the washing machine shell and the support damping piece supports the outer barrel at the bottom or the side wall of the outer barrel, so that the anti-deviation capability of the barrel assembly can be enhanced. The suspension damping piece and the support damping piece are cooperated installed and in staggered arrangement. Their complementarity further enhances the anti-deviation capability of the barrel assembly and reduce the vibration effect at a low-speed corresponding to the resonance point.

3. The washing machines includes a horizontal damping piece arranged in horizontal direction which can reduce the vibration of the outer and inner barrel in the horizontal direction. Preferably, the horizontal damping piece is arranged between the suspension damping piece and the support damping piece in the vertical direction, which can realize more effective shock absorption. The suspension damping piece, the support damping piece and the horizontal damping piece working together can reduce the vibration effect at a low-speed corresponding to the resonance point significantly.

The implementation of the disclosure will be described in further detail with reference to the attached figures.

BRIEF DESCRIPTION OF THE DRAWINGS

As a part of the disclosure, the attached drawings are used to provide a further understanding of the disclosure. The embodiments and descriptions of the disclosure are used to explain the disclosure and is not to be considered as improper limitation of the disclosure. Obviously, the following drawings are only some embodiments. For the person skilled in the art, other drawings can be obtained according to these drawings without any creative work. In the attached figures.

Figure 1:
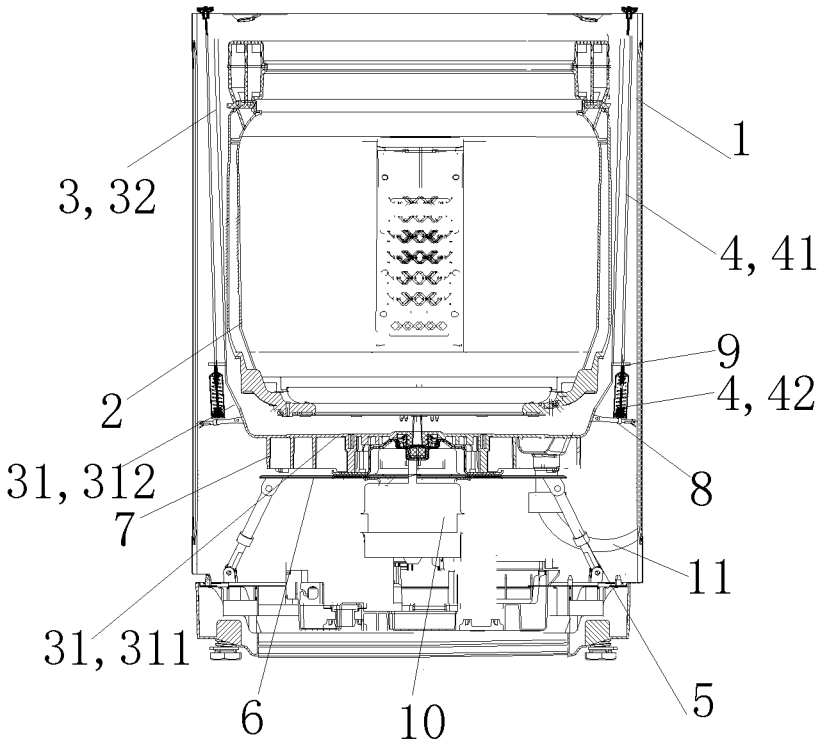
FIG. 1 is a sectional view of an washing machine of the disclosure.

In the drawings: 1, washing machine shell; 2, inner barrel; 3, outer barrel; 31, outer barrel bottom; 311, bottom wall; 312, side wall; 32, outer barrel body; 4, suspension damping piece; 41, suspension rod; 42, damping sleeve; 5, support damping piece; 6, mounting plate; 7, stiffener; 8, horizontal damping piece; 9, mounting portion; 10, motor; 11, drainage pipe; 12, damping buffer; 121, sheathing portion; 122, shock absorbing portion; 13, spring assembly; 14, bracket; 14-1, tubular flange; 14-2, transition structure; 15, sleeve; 16, annular concave; 17, sealing cover.

It should be noted that these drawings and descriptions are not to limit the conception of the disclosure in any way, but to illustrate the concept of the disclosure for the person skilled in the art by referring to specific embodiments.

DETAILED DESCRIPTION

The technical scheme in the following embodiments will then be described clearly and completely with combination with the attached figures in order to make the purpose, technical scheme and advantages of the disclosure clearer. The following embodiments are used to illustrate the disclosure but are not used to limit the scope of the disclosure.

In the following description, it should be noted that the terms "up", "down", "front", "back", "left", "right", "vertical", "inside", "outside" and etc. are based on the directions or positions shown in the attached figures. They are used to simplify the description, rather than to indicate that the device or element referred must have a specific direction or to be constructed or operated in a specific direction.

And in the following description, it should be understood that the terms "installment" and "connection" should be treated according to generalized understanding. For example, they can be understood as fixed connection, detachable connection or integrated connection. Also, they can mean mechanical connection or electrical connection. They can also represent direct connection or indirect connection. The person skilled in the art are able to understand the specific meaning of the above terms in the disclosure according to the specific situation.

Embodiment 1

Figure 2:
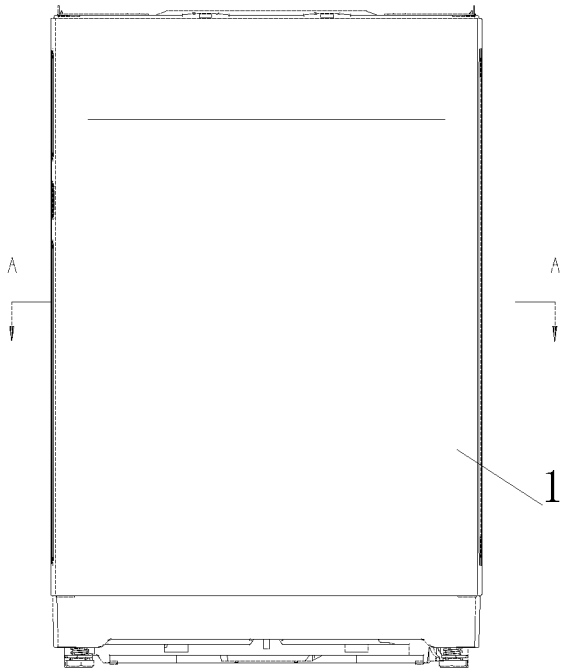
FIG. 2 is a front view of an washing machine of the disclosure.
Figure 3:
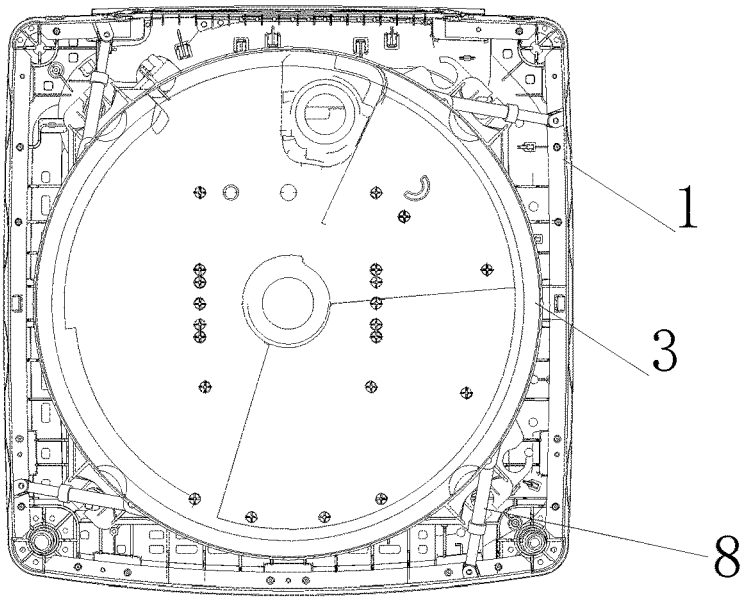
FIG. 3 is a cross-sectional view taken along line A-A of FIG. 2.
Figure 4:
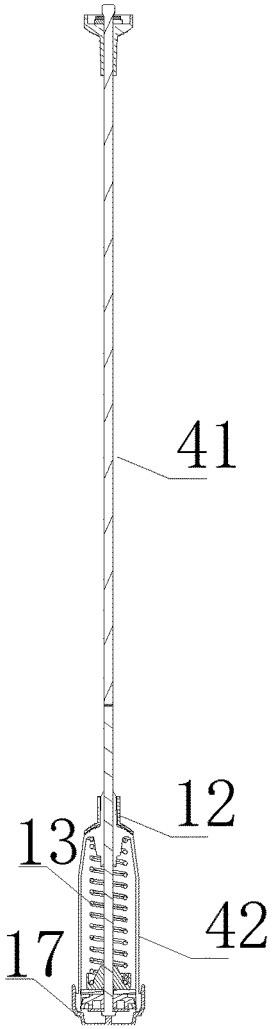
FIG. 4 is a sectional view of a suspension damping piece of the disclosure.
Figure 5:
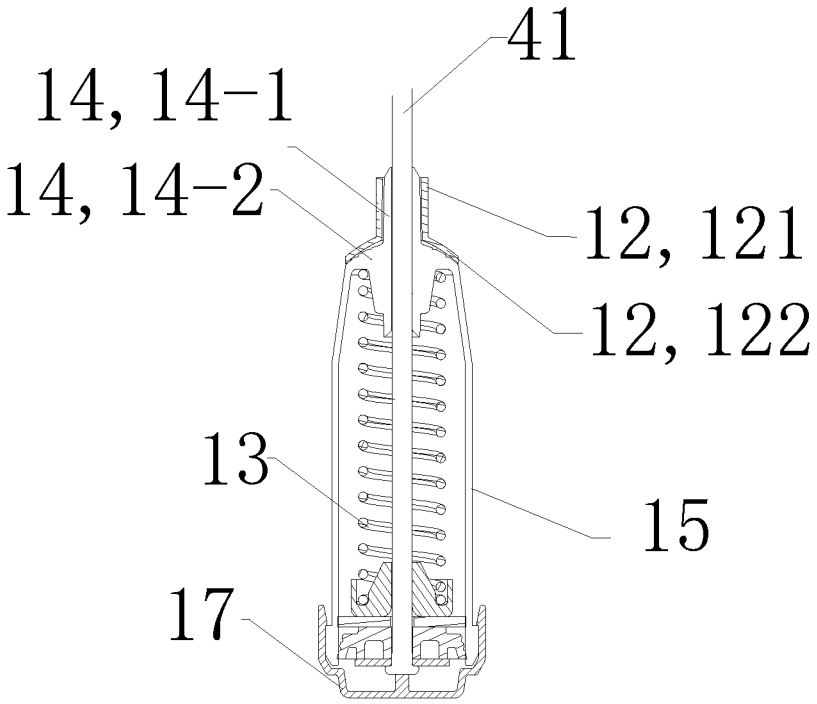
FIG. 5 is a sectional view of the damping sleeve of the suspension damping piece and the shock absorber.
Figure 6:
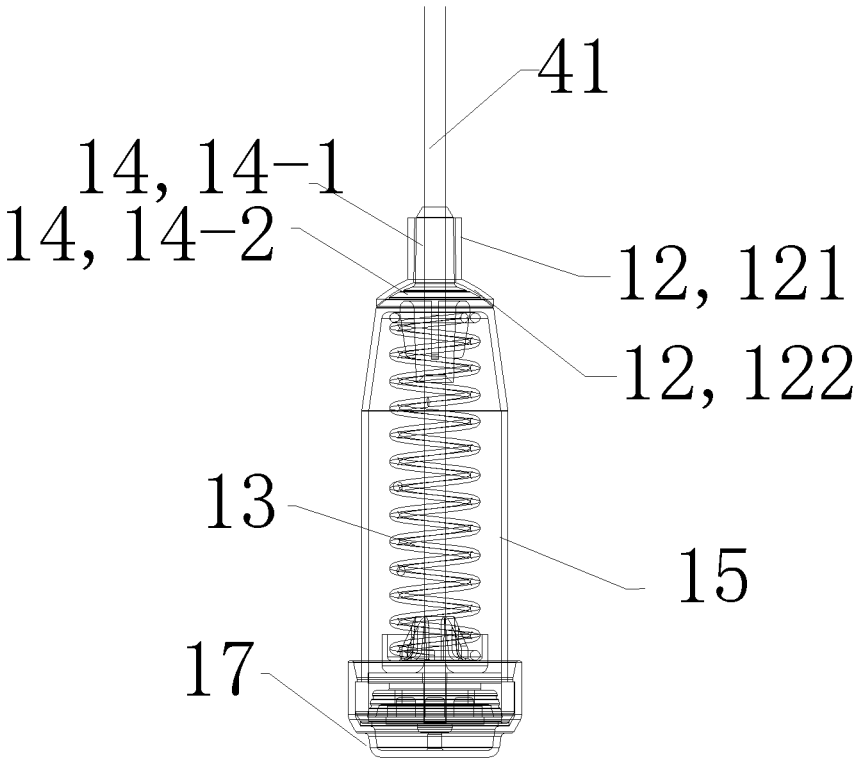
FIG. 6 is a perspective view of the damping sleeve of the suspension damping piece and the shock absorber after installment.
Figure 7:
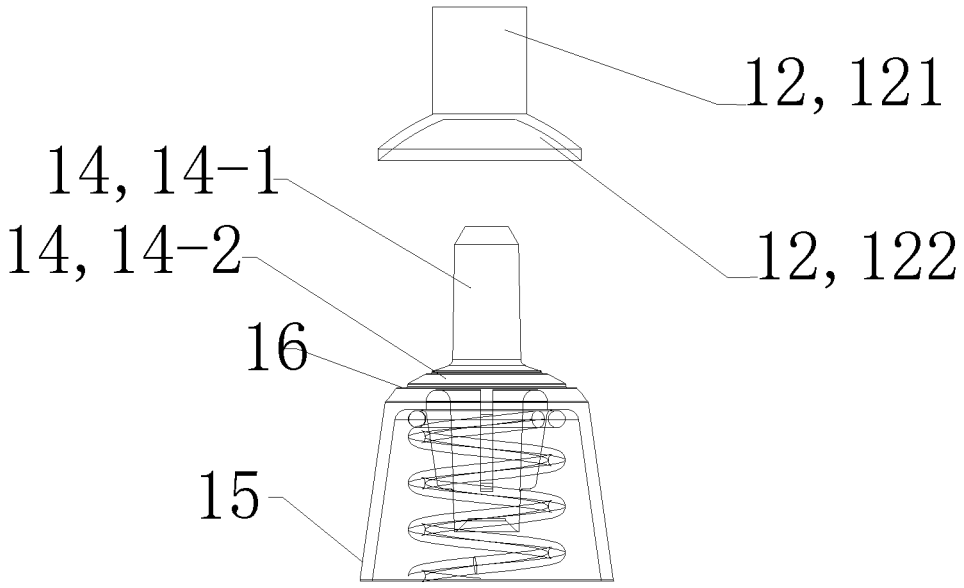
FIG. 7 is a perspective view of the damping sleeve of the suspension damping piece and the shock absorber before installment.

As illustrated in FIG. 1-3, the embodiment herein discloses a washing machine comprising a washing machine shell 1, an inner barrel 2 and an outer barrel 3 which are arranged in the washing machine shell 1. The washing machine also includes a suspension damping piece 4 and a support damping piece 5 which are both arranged between the washing machine shell 1 and the outer barrel 3, and the suspension damping piece 4 and the support damping piece 5 are connected with the washing machine shell 1 and the outer barrel 3 respectively. The suspension damping piece 4 suspends the outer barrel 3 in the washing machine shell 1 and the support damping piece 5 supports the outer barrel 1. The support damping piece 5 and the suspension damping piece 4 work together to reduce the shaking of the inner barrel 2 and the outer barrel 3.

The suspension damping piece 4 and the support damping piece 5 are both arranged between the washing machine shell 1 and the outer barrel 3, so that they absorb the shock in different ways and corporate with each other to reduce the shaking of the inner barrel 2 and the outer barrel 3. Also, they can greatly reduce the probability that the barrel assembly, comprising the inner barrel 2 and the outer barrel 3, hits the washing machine shell during the clothes washing process. In this way, the anti-deviation capability of the barrel assembly can be enhanced and the vibration effect at a low-speed corresponding to the resonance point can also be reduced. And the noise of the washing machine can also be reduced, as well as the safety of the washing process can be enhanced, so that the user experience is improved.

One end of the suspension damping piece 4 is connected with the upper part of the washing machine shell 1, and the other end is connected with the side wall of the outer barrel 3. One end of the support damping piece 5 is hinged with the lower part of the washing machine shell 1, and the other end is hinged with the bottom or the side wall of the outer barrel 3. The suspension damping piece 4 and the support damping piece 5 are in staggered arrangement.

A mounting portion 9 for mounting the suspension damping piece 4 is provided to the side wall of the outer barrel 3. The mounting portion 9 protrudes outwards the outer barrel 3. The suspension damping piece 4 includes a suspension rod 41 and a damping sleeve 42 which is used to create damping force. One end of the suspension rod 41 is fixed or integrated connected with the damping unit. The damping sleeve 42 is arranged under the mounting portion 9. The suspension rod 41 goes through the mounting portion 9 on the side wall of the outer barrel 3 and is suspended on the upper part of the washing machine shell 1.

After installment, the damping sleeve 42 is stuck in the mounting portion 9. When the washing machine shakes, the suspension rod 41 and the damping sleeve 42 shake with it, resulting in the deformation of the damping piece in the damping sleeve 42. The reverse force, created to restore the deformation, can offset the force created by the shake so that the vibration of the washing machine can be reduced. The suspension damping piece 4 can greatly reduce the vertical vibration of the washing machine, so that the relative motion of the washing machine and the ground can be avoided. As a result, the great noise caused by it can be eliminated.

One end of the suspension damping piece 4, where the damping sleeve 42 is settled, is connected with the side wall of the outer barrel 3. It makes the suspension rod 41 can be hung in the washing machine shell 1 without any hinder and also avoids the suspension rod 41 hit the outer barrel 3.

The support damping piece 5 is arranged under the outer barrel 3. The two ends of the support damping piece 5 is respectively hinged with the washing machine shell 1, and the bottom or side wall of the outer barrel 3, so that it can rotate relatively to the washing machine shell 1 and the outer barrel 3. Preferably, a damper is used as the support damping piece 5. When the washing machines is shaking, the support damping piece 5 can create damping force opposite to the force caused by the vibration in order to reduce the vibration.

Specifically, the damper includes a sleeve and a piston rod extending into the sleeve. The sleeve is filled with liquid or gas. One end of the piston rod which extends from the sleeve is connected with the side wall 312 of the outer barrel bottom 31. The bottom of the sleeve is connected with the internal wall of the washing machine shell 1.

The damper is a pneumatic damper or a hydraulic damper.

The suspension damping piece 4 is arranged at the side of the outer barrel 3 and the support damping piece 5 is arranged at the bottom or under the side wall of the outer barrel 3. Thus, these two kinds of damping piece are vertically disposed. In other words, the suspension rod 41 is used in the upper part of the washing machine and the damper is used in the lower part. They work together to reduce the vibration and bring greater shock absorption.

The suspension damping piece 4 and the support damping piece 5 can be arranged in the same vertical plane or in different vertical planes. Preferably, they are arranged in different vertical planes. That is to say, they are staggered up and down. In this way, it can reduce the vibration more evenly and stably.

Further, the washing machine includes several suspension damping pieces 4 which are evenly distributed along the circumference of the outer barrel 3. It also includes several support damping pieces 5 which are evenly distributed around the central axis of the outer barrel 3. The horizontal projection of the suspension damping pieces 4 and the horizontal projection of the support damping pieces 5 are alternatively distributed.

Several suspension damping pieces 4 and several support damping pieces 5 can be included in the washing machine and they are evenly distributed at the side of the outer barrel 3 and at the bottom or at the side wall of the outer barrel 3, respectively. This kind of setting can help distribute the force and make the force loaded on every damping piece equal. In this way, the anti-deviation capability of the outer barrel 3 and the inner barrel 2 can be greatly enhanced. It can avoid damage of a single damping piece because of overloaded so that it can bring great shock absorption.

In this way, the horizontal projection of the suspension damping pieces 4 and the horizontal projection of the support damping pieces are alternatively distributed. In other words, the support damping piece 5 is arranged under the space of two nearest suspension damping piece 4 and the suspension damping piece 4 is arranged above the space of two nearest support damping piece 5. Thus, the damping pieces can cooperate with each other and reduce the vibration in various direction. It can further enhance the anti-deviation capability of the outer barrel 3 and the inner barrel 2 and also reduce the probability that the outer barrel 3 hits the washing machine shell 1.

Preferably, the angles formed by the horizontal projection of the suspension damping piece 4 and that of the two nearest suspension damping piece 4 are equal to each other.

In this way, the distances between each two nearest suspension damping pieces 4 are the same, the distances between each two nearest support damping pieces 5 are the same, and also the distances between each support damping pieces 5 and the nearest suspension damping pieces 4 are the same. It can distribute the force, caused by the shake of the washing machine, to each damping piece evenly. As a result, the probability that the outer barrel 3 deviate from its original position can be greatly reduced. Also, the damping piece can absorb the shock rapidly, keeping the washing machine stable and reducing the noise.

Further, both the suspension damping pieces 4 and the support damping pieces 5 are arranged in pairs, each pair of suspension damping pieces 4 and support damping pieces 5 are symmetrical to the central axis of the outer barrel 3. It can avoid the shifting of the outer barrel 3 to one side caused by uneven force distribution and can enhance the anti-deviation capability of the barrel assembly.

Specifically, a pair of suspension damping pieces 4 and a pair of support damping pieces 5 are provided in the washing machine. Both the suspension damping pieces 4 and the support damping pieces 5 are arranged symmetrically. The vertical plane formed by two suspension damping pieces 4 is perpendicular to that form by two support damping pieces 5. The four damping pieces can distribute the shaking force in various direction so that good shock absorption can be obtained. It is obvious that the two suspension damping pieces 4 and two support damping pieces 5 arranged in the same vertical plane can also reduce the vibration.

Preferably, two pairs of suspension damping pieces 4 and two pairs of support damping pieces 5 are provided in the washing machine. The plane formed by the two pairs of suspension damping pieces 4 are perpendicular to each other, and the plane formed by the two pairs of support damping pieces 5 are perpendicular to each other.

Four suspension damping pieces 4 are evenly distributed on the outside of the outer barrel and four support damping pieces 5 are evenly distributed at the bottom or around the side wall of the outer barrel 3. In this way, the plane formed by the two pairs of suspension damping pieces 4 are perpendicular to each other, and the plane formed by the two pairs of support damping pieces 5 are perpendicular to each other. It can enhance the anti-deviation capability of the barrel assembly and also reduce the vibration effect of a low-speed over-resonance point.

Further, the suspension damping piece 4 and the support damping piece 5 are arranged between the washing machine shell 1 and the outer barrel 3 with tilting position. In this way, the structure is more stable, and more space can be left for the shock absorption. It can reduce the vibration not only in the vertical direction, but also in other directions.

Preferably, the suspension damping piece 4 tilts outwards from bottom to top; the support damping piece 5 tilts inwards from bottom to top.

When the washing machine is shaking, the outer barrel 3 shifts outwards. The distance between the end of both kinds of damping pieces that connected with the washing machine shell 1 is farther than the distance between the end that connected with the outer barrel 3. Thus, the damping pieces can create greater deformation or damping force and bring greater shock absorption. Because the vibration of the upper part of the outer barrel 3 is greater than that of the lower part, the suspension damping piece 4 tilts outwards from bottom to top. The upper end of it is farther to the outer barrel 3 than the lower end, so that it can avoid the outer barrel 3 hits the suspension 41. Also, it can be hung in the upper part of the washing machine shell 1 more stably.

Embodiment 2

As illustrated in FIG. 1-3, the embodiment herein is a further limitation of embodiment 1. The outer barrel 3 includes an outer barrel bottom 31 and an outer barrel body 32, and the outer barrel body 32 is connected with the upper part of the outer barrel bottom 31. One end of the suspension damping piece 4 is connected with the side wall of the outer barrel body 32, the other end is connected with the washing machine shell 1. One end of the support damping piece 5 is connected with the bottom or the side wall of the outer barrel bottom 31, and the other end is connected with the washing machine shell 1.

The side wall of the outer barrel body 32 is a kind of vertical, and a mounting portion 9 is provided to the side wall. The mounting portion 9 protrudes outwards the outer barrel 3 and is coordinated with the damping unit of the suspension damping piece 4. The suspension damping piece 4 is installed in the mounting portion 9 so that the suspension rod 41 won't meet any hinder. The support damping piece 5 is connected with the bottom or side wall of the outer barrel bottom 31. The two kinds of damping piece both work on the outer barrel 3 and reduce the vibration together.

A mounting plate 6, arranged under the outer barrel bottom 31, is fixedly connected with the outer barrel bottom 31. One end of the support damping piece 5 is connected with the mounting plate 6, the other end is connected with the washing machine shell 1.

By arranging the mounting plate 6 under the outer barrel bottom 31, motor 10 and other driving device can be installed on it. Also, it can support the outer barrel 3 and the inner barrel 2 and enhance the anti-deviation capability of the barrel assembly. The support damping piece 5 is connected with the mounting plate 6, so that the vibration of the outer barrel 3 and the inner barrel 2 can be reduced. The vibration of the mounting plate 6 and the driving device can also be reduced, and the shock absorption can be further enhanced.

Preferably, the mounting plate 6 is connected with the bottom of the outer barrel bottom 31 by a stiffener 7 so that the fixed connection can be realized. Also, the inner barrel 2 and the outer barrel 3 can be well supported. The stiffener 7 is designed to coordinated to the distance between the motor 10 and the outer barrel bottom 31. So it can avoid that the motor 10 tends to shake because of high center of gravity.

Multiple stiffeners 7 are vertically arranged between the bottom of the outer barrel bottom 31 and the mounting plate 6. The stiffeners 7 are used instead of a solid structure as the support unit so that the weight of the washing machine can be reduced.

An outlet is provided to the bottom wall 311 of the outer barrel bottom 31. The outlet connects with the drainage pipe 11 to drain water out of the inner barrel 2 and the outer barrel 3.

Further, the opening of the outer barrel 3 is lower than the opening of the inner barrel 2.

The outer barrel 3 of this embodiment is an usual outer barrel 3. The height of the opening of the outer barrel 3 is leveled with or higher than the opening of the inner barrel 2. Also, the opening of the outer barrel 3 can be lower than the opening of the inner barrel. Further, the outer barrel 3 can be provided without a barrel body and only the outer barrel bottom 31 or other similar structure as the collecting unit to collect the water drained from the inner barrel 2 is provided. As a result, more space can be left to enlarge the volume of the inner barrel 2.

In this embodiment, both the suspension damping piece 4 and the support damping piece 5 can reduce the vibration of the outer barrel 3 or barrel assembly with various height. They can enhance the anti-deviation capability of the barrel assembly, particularly reduce the vibration effect of a low-speed over-resonance point.

Embodiment 3

As illustrated in FIG. 1-3, the embodiment herein is a further limitation of embodiment 1 or 2. The washing machine of the present embodiment also includes a horizontal damping piece 8, and horizontal damping piece 8 is arranged between the outer barrel 3 and the washing machine shell 1 in horizontal direction. It is connected with the outer barrel 3 and the washing machine shell 1 respectively to reduce the horizontal vibration of the outer barrel 3 and the inner barrel 2.

During the clothes washing process, when the speed of the inner barrel 2 decreases to a particular range, usually close to the resonance point, the inner barrel 2 shakes greatly in the horizontal direction. It is easy to cause that the outer barrel 3 hits the washing machine shell 1, resulting in the damage of the outer barrel 3 and the washing machine shell 1. In order to reduce the shaking of the outer barrel 3 in the horizontal direction, a horizontal damping piece 8 is provided in this embodiment to reduce horizontal vibration during the washing process, and enhance the anti-deflection capability of the inner barrel 2 and the outer barrel 3, especially to reduce the rotation speed of the washing machine to reach resonance vibration at the point of time, reducing the possibility that the outer barrel 3 hits the washing machine shell 1

Preferably, the horizontal damping piece 8 is hinged with the outer barrel 3 and the washing machine shell 1 respectively. And it is arranged between the suspension damping piece 4 and the support damping piece 5 in the vertical direction. The horizontal damping piece 8 can reduce the horizontal vibration. And arranged between the suspension damping piece 4 and the support damping piece 5, it can offset the inadequate shock absorption of them in horizontal direction. The three kinds of damping pieces work together to reduce the probability that the barrel assembly hits the washing machine shell 1. It can also enhance the anti-deviation capability of the barrel assembly, particularly reduce the vibration effect at a low-speed corresponding to the resonance point. And the noise of the washing machine can also be reduced, as well as the safety of the washing process can be enhanced, so that the user experience can be improved.

Further, the outer barrel bottom 31 includes a bottom wall 311 and a side wall 312 which are enclosed to form the outer barrel bottom 31. The horizontal damping piece 8 is connected with the side wall 312 of the outer barrel bottom 31 and the support damping piece 5 is connected with the bottom wall 311 of the outer barrel bottom 31. In this way, the horizontal damping piece 8 is provided between the suspension damping piece 4 and the support damping piece 5, and it is connected with the outer barrel 3. So it can reduce the horizontal vibration of the outer barrel 3.

Preferably, the diameter of the side wall 312 of the outer barrel bottom 31 increases gradually from bottom to top. The horizontal damping piece 8 is connected with the side wall 312 of the outer barrel bottom 31 at a part which has a smaller diameter. In this way, the horizontal damping piece 8 is movable in a larger space, resulting in greater shock absorption in horizontal direction.

Multiple horizontal damping pieces 8 are arranged in pairs around the side of the outer barrel bottom 31. In each pair, two damping pieces 8 are opposite to each other. In this way, it is easier to keep the outer barrel 3 in equilibrium of forces, so that the probability that the outer barrel 3 hits the washing machine shell 1 can be reduced.

The horizontal damping piece 8, the suspension damping piece 4 and the support damping piece 5 can be staggered up and down and they can also be arranged in the same plane. The horizontal projection of the horizontal damping piece 8, the suspension damping piece 4 and the support damping piece 5 are alternatively distributed in turn, so that the vibration of the washing machine can be distributed as much as possible. And then it can reduce the vibration rapidly and also avoid the deviation of the outer barrel 3 hitting the washing machine shell 1.

The horizontal damping piece 8 is a damper arranged horizontally. It includes a sleeve and a connecting rod. A damping element is set in the sleeve and it can be a spring damper or a damping mechanism comprising a piston and damping gas or liquid. One end of the connecting rod extends into the sleeve and connects with the damping element, the other end is connected with the internal wall of the washing machine shell 1 or the side wall 312 of the outer barrel bottom 31. Correspondingly, the sleeve is connected with the side wall 312 of the outer barrel bottom 31 or the internal wall of the washing machine shell 1.

Specifically, the damper includes a sleeve and a piston rod extending into the sleeve. The sleeve is filled with liquid or gas. One end of the piston rod which extends from the sleeve is connected with the side wall 312 of the outer barrel bottom 31. The bottom of the sleeve is connected with the internal wall of the washing machine shell 1.

The damper is a pneumatic damper or a hydraulic damper.

Embodiment 4

As illustrated in FIG. 4-7, the embodiment herein is a further limitation of embodiment 1. The suspension damping piece 4 is provided which comprises a suspension rod 41 and a damping sleeve 42 sheathing the lower end of the suspension rod 41. A mounting portion is provided to the bottom or the side wall of the outer barrel to hang with the damping sleeve 42. The damping sleeve 42 is set under the mounting portion, and the suspension rod 41 goes through the mounting portion and is suspended on the washing machine shell. The suspension damping piece 4 also includes a damping buffer 12. The damping buffer 12 is sleeve-connected with the suspension rod 41 between the mounting portion and the damping sleeve 42. And it covers the top surface of the damping sleeve 42 to reduce the vibration.

The suspension damping pieces 4 are arranged at the four corners of the washing machine. Mounting portions are provided to the side wall of the outer barrel of the washing machine. The lower ends of the suspension rods 41 are set in the mounting portions on the outer barrel, the other ends are hung at the corresponding corner of the washing machine. The outer barrel of the disclosure is a usual outer barrel. It can also be an outer barrel that is much lower than the inner barrel in height, namely, the outer barrel or the water collecting unit that cooperate with the inner barrel without hole to collect the water drain from the inner barrel. Only the mounting portions are arranged around the outer barrel or the water collecting unit.

Spring assembly 13 and a spring base to fix the spring assembly 13 are arranged in the damping sleeve 42. The suspension rod 41 is used to connect these components. The mounting portion is usually a seat with a hole to suspend other components. The suspension rod 41 goes through the hole and is hung at the corresponding position in the washing machine shell. The damping sleeve 42 at the lower end of the suspension rod 41 is stuck at the bottom part of hole. In this way, the suspension rod 41 can reduce the vibration of the inner barrel and the washing machine when the washing machine is shaking.

In this embodiment, the damping buffer 12 of the suspension damping piece 4 is between the mounting portion and the damping sleeve 42 and it covers the top surface of the damping sleeve 42. Compared with the damping pad in the prior art, it enlarges the contact area of the damping sleeve 42 and the mounting portion. Thus, the area between the mounting portion and the damping sleeve 42 that covered with flexible material increases. As a result, when the washing machine is shaking, leading to the suspension damping piece 4 moving up and down, left and right, the stress and vibration created by the hit and shake of the mounting portion and the damping sleeve 42 can be reduce. It brings great shock absorption and can help reduce the shake of the washing machine.

In addition, the contact areas of the damping buffer 12 with both the damping sleeve 42 and the mounting portion increase. It can not only reduce the vibration of the suspension damping piece 4 and the washing machine, but also reduce the stress and impact that the damping buffer faces. Because the force is distributed, the damping buffer 12 is difficult to damage, so that the service life of it is prolonged and the cost of replacement is reduced.

Further, the damping sleeve 42 includes a bracket 14 and a sleeve 15 which are integrated formed. The bracket 14 plugs the top opening of the sleeve 15. The bracket 14 includes a tubular flange 14-1 that extends upwards along the suspension rod 41 and a transition structure 14-2 that extends from the tubular flange 14-1 to the top opening of the sleeve 15. The damping buffer 12 includes a sheathing portion 121 and a shock absorbing portion 122. The sheathing portion 121 is sleeve-connected with the tubular flange 14-1 and the shock absorbing portion 122 cover the external surface of the transition structure 14-2.

The bracket 14 of the damping sleeve 42 is integrated formed with the sleeve 15 and plugs the top opening of the sleeve 15. The bottom opening of the sleeve is sealed with the sealing cover 17 so that an enclosed chamber is formed inside the damping sleeve 42. The spring assembly 13 is enclosed in the damping sleeve 42 to avoid corrosion. An upper part of the bracket 14 extends upwards along the suspension rod 41 to form a tubular flange 14-1 and a lower part of the bracket 14 extends downwards along the suspension rod 41 to form a fitting seat to fixed connect with the spring base. The diameter of the tubular flange 14-1 is smaller than that of the sleeve 15, so the lower end of the tubular flange 14-1 needs to extend downwards and outwards to integrate with the top opening of the sleeve 15, forming the transition structure 14-2.

The damping buffer 12 of this embodiment is made of flexible material. The tubular flange 14-1 is sheathed in the sheathing portion 121 and the sheathing portion 121 is stuck under the mounting portion, so that the damping effect on sliding can be achieved. Thus, the friction of the suspension rod 41 moving up and down is increased and the vibration can be reduced. The damping sleeve 41 and the mounting portion are made of plastic material. The damping sleeve is easy to hit the mounting portion when it shakes vertically. The shock absorbing portion 122 covers the external surface of the transition structure 14-2. That is to say that the top of the damping sleeve 42 is covered by flexible material completely with a large coverage area. The damping buffer 12 is between the damping sleeve 42 and the mounting portion to buffer, so that the impact of the damping sleeve 42 hitting the mounting portion can be reduced as well as the vibration of them. Thus, the shake of the washing machine can be further reduced.

Preferably, the length of the sheathing portion 121 is the same as the length of the tubular flange 14-1. In this way, it can enfold the tubular flange 14-1 completely, enlarging the contact area and increasing the sliding friction.

Further, the sheathing portion 121 wraps outside the tubular flange 14-1 and contacts with the external wall of the tubular flange 14-1 to create sliding friction. The sheathing portion 121 is not fixed to the external wall of the tubular flange 14-1. They can be contacted with or without gap. When relative motion occurs, the sliding friction can be created and the vibration can be reduced.

Further, bulges are provided inside the sheathing portion 121 and contact with the external wall of the tubular flange 14-1 to increase the sliding friction. The sheathing portion 121 has a tube-like structure, the bulge raised to the suspension rod 41 are provided to the internal wall of the sheathing portion 121. The bulges can be multiple dot bulges, bar bulges, spiral bulges or bulges with other shape that can increase the friction. And they can be in regular or irregular arrangement.

Preferably, the bulges are annular ribs along the circumference of the suspension rod 41 and are arranged with gap between each other. The annular ribs can further increase the sliding friction so that the vibration can be reduced.

Further, the diameter of the tubular flange 14-1 is smaller than that of the sleeve 15. The bottom end of the tubular flange 14-1 extends outwards to the top opening of the sleeve 15, forming the transition structure 14-2. The external surface of the transition structure 14-2 is a flat or curved surface that tilts downwards from the axial center of the suspension rod 41 to the outside. The shock absorbing portion 122 is cooperated with the external surface of the transition structure 14-2, covering the external part of the transition structure 14-2 and contacting with it.

Because the diameter of the tubular flange 14-1 is smaller than the diameter of the sleeve 15, the lower end of the tubular flange 14-1 needs to extend downwards and outwards to integrate with the top opening of the sleeve 15. The external surface of the transition structure 14-2 tilts downwards from center to all around, so that the extrusion force can be reduced when the top of the damping sleeve 42 is stuck in the mounting portion and shakes up and down, left and right. Thus, the damage of the damping sleeve 42 can be avoided. The shock absorbing portion 122 covers the inclined external part of the transition structure 14-2, so that the vibration created by the hit can be further reduced.

Further, the bottom end of the sheathing portion 121 extends outwards to form the shock absorbing portion 122. The internal surface of the shock absorbing portion 122 is cooperated with the external surface of the transition structure 14-2. The shock absorbing portion 122 covers the transition structure 14-2 and form a smooth transition with the external surface of the sleeve 15. Preferably, the internal surface of the shock absorbing portion 122 and the external surface of the transition structure 14-2 are curved surface that coordinated with each other.

The size and shape of the shock absorbing portion 122 is matched with the transition structure 14-2. The transition structure 14-2 is a flat or curved surface that tilts downwards from the axial center of the suspension rod 41 to the outside. Correspondingly, the shock absorbing portion 122 is a flat or curved surface that tilts downwards from the bottom edge of the sheathing portion 121 to the outside, so that it can cover the external surface of the transition structure 14-2 and contact with it. In this way, the coverage area of the flexible material increases greatly and the shock absorbing portion 122 and the transition structure 14-2 is difficult to shift. When the damping sleeve hits the mounting portion, the force and the vibration can be reduced. The smooth transition between the shock absorbing portion 122 and the sleeve 15 makes the structure attractive in appearance. Also, it can avoid that the edge of the shock absorbing portion 122 is squeezed or the edge of the top surface of the damping sleeve 42 is not covered by the shock absorbing portion 122, so that it can help reduce the vibration. The internal surface of the shock absorbing portion 122 and the external surface of the transition structure 14-2 are curved surface that coordinated with each other, so that the force of the hitting can be further reduced, and it can avoid damage caused by being squeezed.

Further, an annular concave is provided to the end of the transition structure 14-2 that close to the sleeve 15. The edge of the shock absorbing portion 122 is cooperated with the annular concave 16. When the damping buffer 12 is installed onto the suspension rod 41, the edge of the shock absorbing portion 122 is stuck in the annular concave 16.

The annular concave 16 is arranged at the bottom end of the transition structure 14-2 along its circumference. The edge of the shock absorbing portion 122 is matched with the annular concave 16 and inserts into it. It can avoid the deviation of the damping buffer 12 more efficiently, ensuring that the damping buffer 12 can cover the top of the damping sleeve 42 completely during the vibration. So, the impact between the damping sleeve 42 and the mounting portion can be reduced and then the vibration can be reduced.

Further, the edge of the shock absorbing portion 122 extends along the axis of the suspension rod 41. The thickness of it is coordinated with the annular concave 16 and it form a smooth transition to the external surface of the sleeve 15.

The external surface of the shock absorbing portion 122 extends from center to all around, and at the edge, it changes the extending direction and extends along the axis of the suspension rod 41, so that it can cover the top of the damping sleeve 42 and avoid the deviation of the damping buffer 12 during vibration. Meanwhile, the edge of the shock absorbing portion 122 form a smooth transition to the external surface of the sleeve 15, so that it can protect the edge from damage when hit during vibration.

The above description is just used to illustrate some more practical embodiments of the disclosure but is not the limitation of the disclosure in any way. Although the disclosure has been enclosed as the above embodiments, they are not used to limit the disclosure. Within the technical scheme of the disclosure, any person skilled in the art should be able to make some changes or modifications based on the above techniques to obtain other embodiments with equal benefits. But any simple changes, equivalent changes or modifications, made to the above embodiments according to the technical substance within the technical scheme of the disclosure, still belong to the protection range of the disclosure.

The invention claimed is:

1. A washing machine, comprising:

a washing machine shell;

an inner barrel and an outer barrel which are arranged in the washing machine shell;

a suspension damping piece; and a support damping piece, wherein:

the suspension damping piece and the support damping piece are arranged between the washing machine shell and the outer barrel, and are connected with the washing machine shell and the outer barrel respectively;

the suspension damping piece suspends the outer barrel in the washing machine shell and the support damping piece supports the outer barrel;

the support damping piece and the suspension damping piece are configured to reduce shaking of the inner barrel and the outer barrel;

the suspension damping piece includes, a suspension rod and a damping sleeve sheathing the lower end of a suspension rod, a mounting portion provided to the bottom or the side wall of the outer barrel to hang with the damping sleeve, the damping sleeve is set under the mounting portion, and the suspension rod goes through the mounting portion and is suspended on the washing machine shell, and a damping buffer, the damping buffer is sleeve-connected with the suspension rod between the mounting portion and the damping sleeve, and the damping buffer covers a top surface of the damping sleeve, the damping sleeve includes a bracket and a sleeve which are integrally formed, the bracket plugs a top opening of the sleeve, the bracket includes a tubular flange that extends upwards along the suspension rod and a transition structure that extends from the tubular flange to the top opening of the sleeve, the damping buffer includes a sheathing portion and a shock absorbing portion, the sheathing portion is sleeve-connected with the tubular flange and the shock absorbing portion cover the external surface of the transition structure.

2. The washing machine according to claim 1, wherein:

one end of the suspension damping piece is connected with an upper part of the washing machine shell, and another end is connected with a side wall of the outer barrel;

one end of the support damping piece is hinged with a lower part of the washing machine shell, and another end is hinged with a bottom or the side wall of the outer barrel; and the suspension damping piece and the support damping piece are in staggered arrangement.

3. The washing machine according to claim 2, wherein:

several suspension damping pieces are provided and are evenly distributed along a circumference of the outer barrel;

several support damping pieces are provided and are evenly distributed around a central axis of the outer barrel; and horizontal projections of the suspension damping pieces and horizontal projections of the support damping pieces are alternatively distributed.

4. The washing machine according to claim 1, wherein:

several suspension damping pieces are provided and are evenly distributed along a circumference of the outer barrel;

several support damping pieces are provided and are evenly distributed around a central axis of the outer barrel; and horizontal projections of the suspension damping pieces and horizontal projections of the support damping pieces are alternatively distributed.

5. The washing machine according to claim 4, wherein the several suspension damping pieces and the several support damping pieces are arranged in pairs, each pair of the several suspension damping pieces and each pair of the several support damping pieces are symmetrical to the central axis of the outer barrel.

6. The washing machine according to claim 5, wherein two pairs of the suspension damping pieces and two pairs of the support damping pieces are provided, and planes formed by the two pairs of the suspension damping pieces are perpendicular to each other, and planes formed by the two pairs of the support damping pieces are perpendicular to each other.

7. The washing machine according to claim 5, wherein the suspension damping piece and the support damping piece are inclinedly arranged between the washing machine shell and the outer barrel.

8. The washing machine according to claim 5, comprising:

a horizontal damping piece, the horizontal damping piece is arranged between the outer barrel and the washing machine shell in a horizontal direction and the horizontal damping piece is connected with the outer barrel and the washing machine shell respectively, so that a horizontal vibration of the outer barrel and the inner barrel is reduced.

9. The washing machine according to claim 4, the wherein angles between each of the horizontal projections of the several suspension damping piece and two nearest horizontal projections of the several support damping pieces are equal.

10. The washing machine according to claim 1, wherein the suspension damping piece and the support damping piece are inclinedly arranged between the washing machine shell and the outer barrel.

11. The washing machine according to claim 10, wherein the suspension damping piece is tilted outwards from bottom to top and the support damping piece is tilted inwards from bottom to top.

12. The washing machine according to claim 1, wherein:

the outer barrel includes an outer barrel bottom and an outer barrel body, and the outer barrel body is connected with an upper part of the outer barrel bottom;

one end of the suspension damping piece is connected with a side wall of the outer barrel body, another end of the suspension damping is connected with the washing machine shell; and one end of the support damping piece is connected with a bottom or a side wall of the outer barrel bottom, and another end of the support damping piece is connected with the washing machine shell.

13. The washing machine according to claim 12, wherein a mounting plate, arranged under the outer barrel bottom, is fixedly connected with the outer barrel bottom, the one end of the support damping piece is connected with the mounting plate, and the other end of the support damping piece is connected with the washing machine shell.

14. The washing machine according to claim 13, wherein an opening of the outer barrel is lower than an opening of the inner barrel.

15. The washing machine according to claim 1, wherein an opening of the outer barrel is lower than an opening of the inner barrel.

16. The washing machine according to claim 15, comprising:

a horizontal damping piece, the horizontal damping piece is arranged between the outer barrel and the washing machine shell in a horizontal direction and the horizontal damping piece is connected with the outer barrel and the washing machine shell respectively, so that a horizontal vibration of the outer barrel and the inner barrel is reduced.

17. The washing machine according to claim 1, comprising:

a horizontal damping piece, the horizontal damping piece is arranged between the outer barrel and the washing machine shell in a horizontal direction and the horizontal damping piece is connected with the outer barrel and the washing machine shell respectively, so that a horizontal vibration of the outer barrel and the inner barrel is reduced.

18. The washing machine according to claim 17, wherein the horizontal damping piece is hinged with the outer barrel and the washing machine shell respectively, and the horizontal damping piece is arranged between the suspension damping piece and the support damping piece in vertical direction.

19. The washing machine according to claim 17, wherein the outer barrel includes an outer barrel bottom having a bottom wall and a side wall which form the outer barrel bottom, the horizontal damping piece is connected with the side wall of the outer barrel bottom and the support damping piece is connected with the bottom wall or side wall of the outer barrel bottom.

20. The washing machine according to claim 19, wherein a diameter of the side wall of the outer barrel bottom increases gradually from bottom to top, and the horizontal damping piece is connected with the side wall of the outer barrel bottom closer to the bottom of the side wall than to the top of the side wall.

* * * * *